US005915534A

United States Patent [19]

May

[11] Patent Number: 5,915,534

[45] Date of Patent: Jun. 29, 1999

[54] CAP WITH DETACHABLE SWEATBAND

[76] Inventor: Jason R. May, 241 5th St., Box A12, Columbus A.F. Base, Miss. 39710-5130

[21] Appl. No.: 09/085,544

[22] Filed: May 27, 1998

[51] Int. Cl.[6] ..... A42C 5/02

[52] U.S. Cl. ..... 2/181.4; 2/181; 2/DIG. 11

[58] Field of Search ..... 2/181, 181.2, 181.4, 2/182.1, 182.2, 182.6, DIG. 11

[56] References Cited

U.S. PATENT DOCUMENTS

| | | | |
|---|---|---|---|
| 2,340,980 | 2/1944 | Ostolaza et al. . | |
| 4,481,681 | 11/1984 | Hankin . | |
| 4,941,210 | 7/1990 | Konucik | 2/181.4 |
| 5,025,504 | 6/1991 | Benston et al. | 2/181.4 |
| 5,181,277 | 1/1993 | Sherman | 2/181 |
| 5,313,668 | 5/1994 | Bogan et al. | 2/181.4 |
| 5,615,415 | 4/1997 | Beckerman | 2/195.3 |
| 5,632,046 | 5/1997 | Green et al. | 2/183 |

*Primary Examiner*—Diana L. Biefeld
*Attorney, Agent, or Firm*—Kenneth L Tola

[57] ABSTRACT

A brimless athletic cap is disclosed that is specifically designed to unobtrusively cover a wearer's head to absorb perspiration. The device includes a bowl shaped, fabric cover member having continuous peripheral edge defining an opening for receiving the crown portion of a user's head. On the back surface of the cap member are a plurality of apertures and an adjustment mechanism for adjusting the circumference of the peripheral edge. An elongated, semi-circumferential sweat band for absorbing perspiration is removably attached to the interior surface of the cap member. The brimless device provides an unobtrusive, perspiration absorbing head covering that does not hinder a user while lifting weights or engaging in similar activity.

4 Claims, 1 Drawing Sheet

CAP WITH DETACHABLE SWEATBAND

BACKGROUND OF THE INVENTION

The present invention relates to an athletic cap that provides an unobstructive means for absorbing perspiration while a user is exercising or is performing similar, strenuous tasks.

DESCRIPTION OF THE PRIOR ART

When lifting weights, jogging or engaging in similar strenuous activities, a person often generates tremendous amounts of perspiration around the head area which subsequently drips into the eyes. Consequently, head bands and similar devices are often wrapped about the person's head to absorb the perspiration. However, such devices are unattractive.

In addition, a person often wishes to wear a head covering while exercising for one reason or another. Baseball caps, visors and similar head wear do not adequately absorb perspiration. The caps are typically made from a thin cloth or similar material that is not capable of absorbing significant amounts of moisture. Furthermore, the cap bill often obstructs the vision or physical movement of a user especially when lifting weights or engaging in similar activity that requires the user's head to be immediately adjacent equipment and other objects. Accordingly, there is currently a need for a head covering that provides an unobtrusive, novel means of absorbing perspiration.

Several caps having integral and removable sweat bands have been heretofore designed. For example, U.S. Pat. No. 5,632,046 issued to Green et al discloses a self-adjusting, fabric-covered sweat band for a hat. The sweat band includes an elastic material and a fabric material. The elastic and fabric are stitched to form first and second circles with the fabric encasing the elastic. The fabric portion is then stitched to the interior of the cap.

U.S. Pat. No. 5,615,415 issued to Beckerman discloses a custom fit cap having a visor portion and a crown portion formed of an expansible material to fit various head sizes. A stretchable band is circumferentially attached to the interior surface of the crown with a continuous seam at one edge and spaced seams at intermittent points along the opposing edge.

U.S. Pat. No. 5,025,504 issued to Benston et al discloses an elongated, band type liner for a helmet, hat, cap or other head covering. The liner is preferably constructed with a liquid absorbent material and has a central portion and tapered sections depending from opposing ends thereof. The liner is adhesively secured to a head covering so that it may be periodically replaced.

U.S. Pat. No. 4,941,210 issued to Konucik discloses a quick-change sweat band. The device includes a strip of loop pile fastener secured to the existing sweat band of a conventional cap. An elongated absorbent pad having a loop pile fastener on its back side is secured to the strip to releasably attach the sweat band to a cap. The circumference of the band is variable with an adjustment mechanism.

U.S. Pat. No. 4,481,681 issued to Hankin discloses an adjustable sweatband for headgear having a flat, generally tubular casing with an open end and a closed end and a vertical opening adjacent the closed end. A semi-rigid strap passes through the casing with an end extending beyond the vertical opening and the other end extending beyond the casing open end. One end of the strap has tabs for matably engaging openings on the opposing end to adjust the sweat band circumference.

U.S. Pat. No. 2,340,980 issued to Ostolaza et al discloses a sweat band structure including a pair of holders attached to the interior surface of a hat for securing a sweat band thereto.

Although numerous sweat bands in combination with various head coverings exist in the prior art, none relate to a brimless cap having a semi-circumferential sweat band removably secured to the interior thereof. The sweat band is secured to the interior of the cap with a clip mechanism that allows a user to effortlessly remove the sweat band for cleaning or replacement.

SUMMARY OF THE INVENTION

The present invention relates to an unobtrusive exercise cap designed to absorb perspiration. The device comprises a bowl shaped fabric cover member for overlaying the crown portion of a user's head. The cover member has a circular peripheral edge, the circumference of which is variable with an adjustment mechanism similar to that found on conventional baseball caps. A plurality of apertures are disposed on at least a portion of the cover member for allowing air to flow therethrough. Removably attached to the interior surface of the cover member, preferably adjacent its peripheral edge, is a semi-circumferential sweatband made from a moisture absorbent material. The band has a plurality of clips depending from an edge thereof which removably seat within sleeves disposed on the inner surface of the cover member to secure the band thereto. It is therefore an object of the present invention to provide an exercise cap that is easy to use and inexpensive to manufacture.

It is yet another object of the present invention to provide an exercise cap that is unobtrusive and does not hinder the physical movement or vision of the wearer.

It is yet another object of the present invention to provide an exercise cap that absorbs significant amounts of perspiration. Other objects, features and advantages of the present invention will become readily apparent from the following detailed description of the preferred embodiment when considered with the attached drawings and the appended claims.

DESCRIPTION OF THE PREFERRED EMBODIMENT

Figure 2:
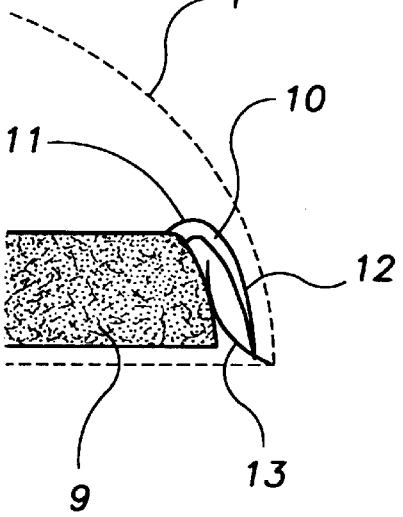
FIG. 2 depicts a partial cut away view of the cover member illustrating the clip mechanism according to the present invention.
Figure 1:
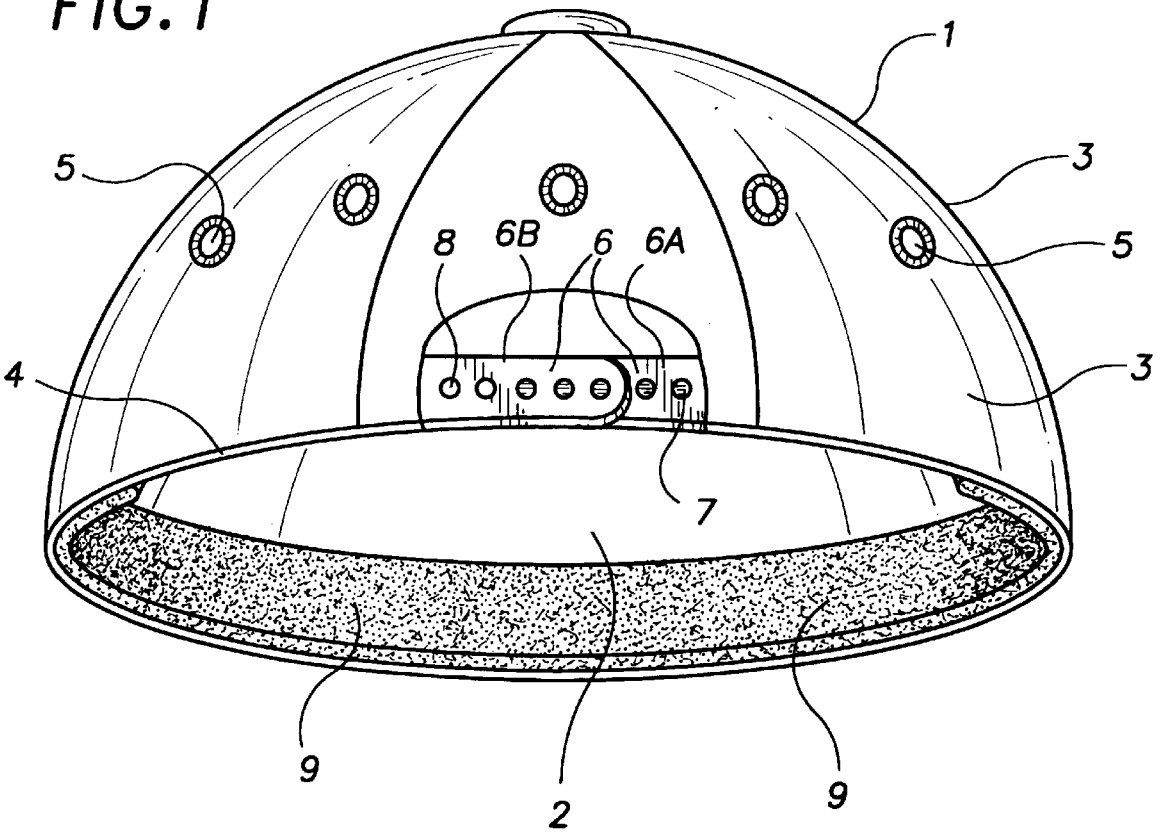
FIG. 1 depicts the inventive device.

Referring now to FIGS. 1 and 2, the present invention relates to a brimless exercise cap designed to absorb perspiration. The device comprises a substantially bowl-shaped cover member 1 for overlaying the crown portion of a user's head. The cover member 1 has an interior surface 2, an exterior surface 3 and a continuous, substantially circular peripheral edge 4. The cover member includes front and rear portions for covering front and rear portions of a user's head respectively. On the rear portion of the cover member are a plurality of apertures 5 allowing ambient air to flow to a user's head while the cover member is being worn.

The peripheral edge 4 is separable at the rear portion of the cover member with a pair of mating straps 6 that function as an adjustment mechanism to allow the cap to fit various size users. A first strap 6A has a plurality of horizontally aligned projections 7 on a side thereof for being removably received within a plurality of horizontally aligned apertures 8 on the opposing strap 6B. The adjustment mechanism resembles that found on a standard baseball cap. However, as will be readily apparent to those skilled in the art, many other conventional adjustment mechanisms may be used without departing from the spirit of the present invention such as, but not limited to, hook and loop fasteners such as VELCRO®, snaps and similar means.

Removably secured to the interior surface of the cap member, preferably extending along the front portion thereof, is an elongated, semi-circumferential band 9 made from a moisture absorbent material such as terrycloth. The band has an interior surface, an exterior surface that abuts the interior surface of the cover member, an upper edge and a lower edge that co-extends with the peripheral edge of the cover member. The band may also be constructed of various other fibrous or cloth materials that are re-usable and are capable of absorbing significant amounts of moisture.

Referring now to FIG. 2, the band has a plurality of clips 10 depending from its upper edge. The clips 10 each have a horizontal portion 11 outwardly depending from the exterior surface of the band adjacent its upper edge and a vertical portion 12 downwardly depending therefrom forming a void space between the vertical portion and the exterior surface of the band. One or more clip receiving structures, such as vertical sleeves 13 having an opening at the top thereof, are sewn into the interior surface of the cover member or are integral therewith for receiving the vertical portions of the clips to detachably secure the band to the cap member. However, as will be readily apparent to those skilled in the art, the band may be secured to the inner surface of the cap member using any conventional attachment means. The sleeves are dimensioned to tightly receive the vertical portions of the clips so that the band does not shift when the cap is being used. The clip and sleeve mechanism allows a user to effortlessly remove or install the sweat band for cleaning or replacing.

The cap member is preferably made from canvas or a similar durable, heavy material while the band is made from terrycloth other similar liquid absorbent materials. However, as will be readily apparent to those skilled in the art, the size, shape and materials of construction of the various components may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A brimless, moisture absorbing athletic cap comprising:

a substantially bowl shaped, fabric cover member dimensioned to overlay the crown portion of a wearer's head having exterior and interior surfaces, front and rear portions, and a continuous peripheral edge defining an opening through which the crown portion of a user's head is inserted, said peripheral edge separably joined at the rear portion of said cover member with an adjustment mechanism for allowing said cover member to conform to various size heads, said cover member having a plurality of apertures on the rear portion thereof allowing air to flow through said cover member;

an elongated semi-circumferential band made from a liquid absorbent, reusable material having an interior surface, an exterior surface, an upper and a lower edge, said band extending along the front portion of said cover member and removably attached to the interior surface thereof with its exterior surface abutting the interior surface of said cover member and its lower edge co-extending with the peripheral edge of said cover member;

a plurality of clips depending from the top edge of said band;

a plurality of vertical clip receiving structures secured to the interior surface of said cover member, each having an open top end, said clip receiving structures spaced along the front portion of said cover member at a distance corresponding to the spacing of said clips, said clip receiving structures dimensioned to tightly receive said clips to prevent the band from shifting while providing an effortless means of removing and installing said band.

2. A device according to claim 1 wherein said band is constructed with terrycloth.

3. A device according to claim 1 wherein said adjustment mechanism comprises a pair of mating bands, a first having a plurality of horizontally aligned projections thereon which are removably received within a plurality of horizontally aligned apertures on a second, opposing band to selectively vary the circumference of the cover member peripheral edge.

4. A brimless, moisture absorbing athletic cap comprising:

a substantially bowl shaped, fabric cover member dimensioned to overlay the crown portion of a wearer's head having exterior and interior surfaces, front and rear portions, and a continuous peripheral edge defining an opening through which the crown portion of a user's head is inserted, said peripheral edge separably joined at the rear portion of said cover member with an adjustment mechanism for allowing said cover member to conform to various size heads, said cover member having a plurality of apertures on the rear portion thereof allowing air to flow through said cover member;

an elongated semi-circumferential band made from a liquid absorbent, reusable material having an interior surface, an exterior surface, an upper and a lower edge, said band extending along the front portion of said cover member and removably attached to the interior surface thereof with its exterior surface abutting the interior surface of said cover member and its lower edge co-extending with the peripheral edge of said cover member;

a plurality of clips depending from the top edge of said band, each clip including a substantially horizontal portion depending outwardly from the exterior surface of said band at its top edge and vertical portion downwardly depending therefrom forming a void space between the vertical portion and the exterior surface of the band;

a plurality of vertical clip receiving structures secured to the interior surface of said cover member, each having an open top end, said clip receiving structures spaced along the front portion thereof at a distance corresponding to the spacing of said clips, said clip receiving structures dimensioned to tightly receive the vertical portions of said clips to prevent the band from shifting while providing an effortless means of removing and installing said band.

* * * * *